United States Patent [19]

Adriaensen et al.

[11] Patent Number: 4,713,153

[45] Date of Patent: Dec. 15, 1987

[54] PROCESS AND APPARATUS FOR CLEANING BY ELECTROCHEMICAL PICKLING WITH ALTERNATING CURRENT OF SPECIFIED FREQUENCY

[75] Inventors: Ludo Adriaensen, Deerlijk; Bernard Decouttere, Beveren Leie, both of Belgium

[73] Assignee: N. V. Bekaert S. A., Zwevegem, Belgium

[21] Appl. No.: 876,498

[22] Filed: Jun. 20, 1986

[30] Foreign Application Priority Data

Jul. 12, 1985 [GB] United Kingdom ..... 8517606

[51] Int. Cl.[4] ..... C25F 1/06

[52] U.S. Cl. ..... 204/144.5; 204/145 R

[58] Field of Search ..... 204/144.5, 145 R

[56] References Cited

U.S. PATENT DOCUMENTS 1,625,484 4/1927 Mason ..... 204/144.5

FOREIGN PATENT DOCUMENTS 511041 8/1939 United Kingdom ..... 204/144.5

613228 11/1948 United Kingdom ..... 204/144.5

1148921 4/1969 United Kingdom ..... 204/144.5

*Primary Examiner*—T. M. Tufariello

*Attorney, Agent, or Firm*—Schwartz, Jeffery, Schwaab, Mack, Blumenthal & Evans

[57] ABSTRACT

A process and apparatus for the electrochemical pickling of ferrous and other metal wires is disclosed. The process, which is particularly suitable for high-carbon steel wires, involves the application of a low voltage alternating current to the wires in a pickling bath containing a selected electrolyte. The frequency of the current is modified as compared with mains frequency, the modification depending on the nature of the electrolyte. The wave-form of the current may also be modified and a suitable direct current may be superimposed.

13 Claims, 9 Drawing Figures

PROCESS AND APPARATUS FOR CLEANING BY ELECTROCHEMICAL PICKLING WITH ALTERNATING CURRENT OF SPECIFIED FREQUENCY

BACKGROUND OF THE INVENTION

1. Field of the Invention

The present invention relates to a process and apparatus for electrolytically cleaning metal strands, such as ferrous wires. More particularly it relates to an improved electropickling process, using alternating current, capable of effecting rapid and essentially complete removal of oxide scale, rust and other undesirable substances from the surface of iron and steel wires. The process can yield extremely clean wire surfaces suitable for subsequent finishing treatments.

2. Related Art

The term ferrous strand as used herein refers to ferrous (e.g. steel) wire, strip, sheet etc. irrespective of composition, length or cross section. The process and apparatus of the invention are however especially suitable for use in the wire industry.

The process of this invention is generally applicable to the in-line cleaning of ferrous strands of variable carbon content, including low-carbon, medium-carbon and high-carbon steel wire with up to more than 1% C. The process is particularly suitable for use in wire pickling lines and can be applied with surprising and advantageous results to carbon steel wires with more than 0.30% C, and especially above 0.45–0.50% C.

In the case of steel wire manufacturing the undesirable substances found on the wire surface frequently take the form of higher oxides (such as ferric and magnetic oxides), hydro-oxides (rust) and also foreign impurities such as dirt particles, lubricant residues, organic or inorganic matter, and often also carbonaceous and graphitic substances derived from burnt lubricant.

Due to the diversity of character of these contaminants, related to the diversity of prior mill operations and the types of wire used, it is often necessary to subject the wire surface to a sequence of cleaning and pickling steps in order to ensure proper cleaning. For removing adherent scales and subsurface penetrated (oxide) particles, it is sometimes necessary to treat steel wires in strong mineral acids and to increase both pickling temperature and residence time. These prior art measures increase the cleaning cost with the need for long processing installations and high consumption of chemicals and energy.

The use of an electrical current to intensify the cleaning action of a chemical pickling bath has been proposed. However, in methods making use of strong acids and employing electrolyzing current "assists" to accelerate the pickling process, there are often problems of overpickling, including significant loss of base metal, and also hydrogen embrittlement which is most undesirable in high-strength applications of carbon steel wires.

To overcome some of the drawbacks of prior art pickling methods, a number of specific electrolytic processes have been developed in which a direct current is applied to the steel wires, mostly in combination with specific electrolyte conditions.

Known processes of this type include for example: electrolytic D.C. pickling of steel wires in hydrochloric acid solutions under carefully controlled electrolytic conditions.

bipolar pickling of high-carbon steel wires in strong sulfuric acid solutions (450–500 g/l of $H_2SO_4$) at a temperature of below 30° C. with high current density (150 $A/dm^2$).

electrolytic D.C. pickling in aqueous salt solutions (sulfates, chlorides) of sufficient conductivity. In the case of D.C. pickling, however, there is the disadvantage that expensive rectifying equipment is needed and also there is usually requirement for a delicate balance of electrolytic processing conditions (polarity, electrolyte temperature, electrolyte composition, etc.). A further disadvantage of direct current pickling of ferrous wire in hydrochloric acid is chlorine gas formation at the current densities needed to effect adequate cleaning. Consequently, electrolytic pickling of carbon steel wire using D.C. is not generally satisfactory and such methods are not industrially important in comparison to the use of hydrochloric acid solutions in the non-electrolytic chemical pickling of wire.

As an alternative to D.C. electrolytic treatments, the use of alternating current has been proposed but prior attempts to use ordinary A.C. (mains frequency 50–60 Hertz) as a cheap source of electrical power to electrolyze steel wires in a hydrochloric acid pickling solution have been largely unsuccessful. One particularly serious problem with the use of an electrolyzing alternating current in the pickling of medium and high-carbon steel wires, e.g. containing at least about 0.30% C and more especially above 0.45% C, is the occurrence of a smut layer on the wire surface. This smut is difficult to remove and gives the wire a dark to black appearance. It is unacceptable because poor adhesion of surface coatings applied subsequent to said pickling operation may result. The real nature and cause of the smut phenomenon are not yet fully understood (overpickling, anodic action and surface oxidation, debris of carbonaceous origin, alloying elements or steel impurities may all play a part) but its occurrence imposes severe limits on the applicability of A.C. electrolyzing current in acid cleaning of steel wires, particularly medium and high-carbon steel wires. Hence, A.C. pickling of medium and high-carbon steel wire in HCl-solutions (in theory a most attractive process) has not been industrially important up to the present time.

OBJECTS AND SUMMARY OF THE INVENTION

A primary object of the present invention is to provide an electrolytic pickling process for the treatment of steel wire which utilises an alternating electrolyzing current and which is applicable to steel wires in general including medium and high-carbon steel wires to provide wires having surfaces of improved cleanness and increased reactivity as compared to prior art pickling methods and more especially to provide wires having surfaces free from smut layers as described above.

A further object is to provide an economical pickling process utilising alternating current which is suitable for the electrolytic pickling of steel wires of low, medium and high-carbon contents.

The present invention is based upon the surprising discovery that the effectiveness of electrolytic cleaning processes utilising alternating current can be improved by the modification of the frequency of the alternating current as compared with mains frequency (50–60 Hertz) and that by means of such modification of the frequency of the alternating current steel wires including such wires having medium and high carbon contents can be treated to provide wire having smut-free surfaces of improved cleanness and increased reactivity as compared to those obtained by prior art pickling methods.

According to one feature of the present invention, there is provided a process for the surface cleaning of ferrous and other metal strands by means of an electrochemical pickling method in which the ferrous strand to be cleaned is passed through an electrolytic pickling bath characterised in that the ferrous strand is subjected to the action of a low voltage alternating current the frequency of which is modified as compared with mains frequency (50–60 Hertz) whereby the effectiveness of the cleaning process is improved.

In a preferred process the metal strand is continuously conveyed past a plurality of spaced apart electrodes arranged along the path of travel of the strand so that the strand passes in turn within a predetermined close distance of each of the said electrodes, electrolyte being provided in the space between each of the said electrodes and the portion of the strand which is adjacent thereto whereby the strand serves as an intermediate conductor between adjacent electrodes.

According to a further feature of the present invention, there is provided apparatus for use in the surface cleaning of ferrous or other metal strands by a process according to the invention as hereinbefore defined which apparatus comprises:

at least one electrolytic picking cell which in use contains the aqueous acid electrolyte;

conveying and supporting means which in use enable the strand to be passed through the said electrolyte in the electrolytic pickling cell;

a plurality of spaced apart electrodes arranged along the path of travel of the strand so that in use the strand passes in turn within a predetermined close distance of each of the said electrodes;

a source of low voltage alternating current for the said electrodes; and means for modifying the frequency of the low voltage alternating current supply from the said source as compared with mains frequency (50–60 Hertz) whereby in use the effectiveness of the cleaning process is improved. The method of this invention is not restricted to the use of an alternating current with the usual sinusoidal wave form. It also includes the use of modified forms, such as pulsed A.C. current, e.g. with anodic and cathodic current periods of equal length or of dissimilar length, and also the use of A.C. of rectangular shape and other variants.

According to one preferred feature of the invention, the alternating current of modified frequency (and if desired also modified wave form) is combined with a superimposed direct current of predetermined voltage (related to the applied current density) so as to modify the anodic character of the A.C. pickling system.

An appropriate electrolytic bath for high-speed A.C. pickling of steel wire preferably comprises an aqueous solution of hydrochloric acid, the concentration of which can for example vary from less than 100 to more than 250 g/l of HCl. The aqueous hydrochloric acid electrolyte usually (but not necessarily) contains ferrous chloride in variable amounts of up to 150 g/l of $FeCl_2$ and preferably less than 140 g/l expressed as weight amount of iron ion (g/l of $Fe^{2+}$). When employing an electrolyte based on hydrochloric acid for performing the electrolytic pickling of high-carbon steel wire of above 0.45% C, the modified frequency for obtaining effective cleaning without formation of smut will be substantially higher than the mains frequency and will in generaly be at least 200 Hertz, preferably at least 400 Hertz and more preferably in the range of from about 500 to 2000 Hertz.

A suitable electrolyte composition may thus for example contain from about 50 to 300 g/l of HCl, preferably 100 to 300 g/l of HCl, and 0 to 120 g/l of $Fe^{2+}$ and the electrolytic pickling can in general be operated at an economic temperature below 60°–65° C. using high frequency alternating current as described above to effect smut-free, rapid and efficient pickling of high-carbon steel wires.

When using electrolyte baths different from the aqueous hydrochloric baths described above, e.g. electrolytic baths based on concentrated salt solutions, mixtures of acids and the like, the modification to the alternating current frequency which is necessary in order to obtain improved effectiveness of cleaning in accordance with the present invention will vary according to the composition of the electrolytic bath. With the knowledge of the criticality of the alternating current frequency, the optimum modified frequency for any particular composition of electrolytic bath can be readily determined. For example, with electrolytic baths based upon aqueous solutions of $Na_2SO_4$ or $K_2SO_4$ or mixtures thereof the desired frequency has been found to be significantly lower than the mains frequency of 50–60 Hertz and the frequency used preferably does not exceed 10 Hertz.

Suitable concentrations of $Na_2SO_4$ range from 100 to 200 g/l at a pH of from 5 to 7.

Effective electrolytic A.C. pickling of steel wires in aqueous sulfuric acid solutions is most advantageously carried out at a low frequency of not more than 5 Hertz. Suitable concentrations of $H_2SO_4$ are from 100 to 500 g/l.

The method of the present invention is not restricted to the above mentioned electrolytes. NaCl, KCl or mixtures thereof, mineral acid mixtures (e.g. $HCl+H_2SO_4$, $HCl+NHO_3$) and various acid/salt mixtures may also be used and the optimum modified frequency determined by simple experiment.

Suitable current densities in electrochemical pickling systems according to the invention are from 25 to 500 $A/dm^2$ of submerged wire surface.

The rapid and unexpectedly efficient cleaning action together with the total absence of pickling smut on the surface of in particular medium and high-carbon steel wires, obtainable by subjecting said wires to the A.C. pickling method of this invention, in particular in the presence of aqueous hydrochloric acid electrolytes, is most surprising in the light of the prior art practice and knowledge, which generally teaches that A.C. pickling of ferrous wires is less effective and that A.C. pickling of high-carbon steel wires results in unavoidable smut formation.

In one preferred embodiment of this invention, steel wires are electrolytically cleaned by passing one or more wires parallel in a (preferably) horizontal plane through an electrolytic bath past a sequence of immersed electrodes and subjecting said wires to an alternating current of modified frequency, preferably by the method of non-contact current flow whereby the wires act as intermediate conductors between adjacent electrodes of opposite polarity which are serially arranged, at a preset close distance from the wire, in the longitudinal bath direction and connected to the terminals of a suitable low-voltage A.C. power supply of the desired modified frequency.

In one particularly preferred embodiment of the apparatus of the invention, the electrolytic processing zone of the pickling apparatus is designed as a single overflow bath divided into a plurality of successive electrolytic cells with continuous circulation of electrolyte, each of said cells containing a plate electrode on its bottom and separated from the adjacent cell (containing a similar plate electrode of opposite polarity) by partition means disposed in said bath transverse to the wire travel and longitudinal cell direction. The partitions prevent undesirable direct flow of A.C. between adjacent electrodes and cause the current to be conducted via the moving wires. In addition they can act as supporting elements for the spaced-apart travelling wires so as to maintain the immersed wires at the required distance from the electrodes. Electrolyte flow is maintained by suitable pumping means for supplying and circulating the electrolyte from a central tank to the electrolytic cells, from which the electrolyte overflow returns to the tank.

The electrolytic cells may advantageously comprise a one-bath integrated construction containing the required number of distinct electrode compartments forming a sequence of spaced-apart electrodes, past which the immersed wires are continuously moved so as to be effectively electrolyzed over the available treatment length.

An alternative apparatus arrangement comprises a sequence of separate overflow cells or baths whereby each bath contains one or more spaced-apart electrodes suitably connected to their corresponding A.C. power terminal, e.g. a sequence of single-electrode cells or a sequence of separate baths each containing two or more spaced-apart electrodes. In this apparatus arrangement only the moving wires form a continuous conduction path between adjacent baths thereby excluding current leakage between electrodes of adjacent cells. In case of a line-stop or a wire stop (e.g. incidental wire break), however, the non-immersed wire portions are readily oxidized and may even heat up, giving a burnt surface. Therefore, in multiwire operations, a one-bath multicell apparatus providing entire wire immersion over the total pickling length is most preferred.

In one particularly preferred embodiment of the apparatus according to the invention as described above, means are provided for supplying a single phase low voltage alternating current of specified frequency. The supply conveniently comprises means for stepping down the mains voltage to a required low voltage and means for converting the mains frequency so as to generate an alternating current of the desired modified frequency in a desired wave form and also means for regulating the current density. In addition means for supplying a predetermined low-voltage D.C. to the wires may be provided whereby said auxiliary D.C. is superimposed on the main A.C. power supply so as to change the active electrolyzing voltage and/or wave form of the applied A.C. in a desired way.

According to our findings, the pickling results for steel wires subjected to a modified high frequency as hereinbefore described in a hydrochloric acid electrolyte are further unexpectedly improved by cathodic superposition of a D.C. voltage, which may vary in height in relation to the amplitude of the applied A.C. voltage and is preferably adapted to attain a fraction of the peak height of said A.C. voltage in a specified range of 0.05 to 0.50. Said cathodic superposition of suitable intensity presumably reduces or compensates the possibly harmful effect of a too active anodic period (depending on actual system electrolytic equilibrium) by a controlled extension of the cathodic period relative to the anodic period of the A.C. cycle. Said cathodic shift may amount to 50% of the peak height of the applied A.C. voltage. A preferred range in A.C. pickling of steel wire in HCl is selected as follows in accordance with applied current density:

| A.C. current density | amount of cathodic D.C. voltage superposition |
|---|---|
| 100 A/dm$^2$ | 0.02 to 0.15 times the peak height of A.C. voltage |
| 150 A/dm$^2$ | 0.05 to 0.20 times the peak height of A.C. voltage |
| 200 A/dm$^2$ | 0.10 to 0.30 times the peak height of A.C. voltage |

These and other aspects of the invention will be more fully understood by reference to the accompanying drawings and the examples which show the results of a selection of pickling treatments as applied to steel wires including high-carbon steel wires containing 0.70 to 0.85% C.

References in the text to "degree of pickling" refer to the following scale, where a series of standard conditions are used to obtain samples of pickled high-carbon steel wires for comparison. Ferrous chloride ($FeCl_2$) content is always expressed as a weight amount of ferrous ion (g/l of $Fe^{2+}$).

TABLE 1

| Pickling degree | Visual Inspection | Laboratory picking conditions to obtain reference |
|---|---|---|
| 1 | silver-white colour | 200 g/l HCl, 40 g/l $Fe^{2+}$, 1 g/l HMT* 70° C., 30 seconds. followed by 500 g/l $H_2SO_4$, 200 A/dm$^2$, cathodic, 25° C., 15 sec. |
| 2 | light grey | 200 g/l HCl, 40 g/l $Fe^{2+}$, 60–65° C., 30 sec. |
| 3 | grey | 200 g/l HCl, 40 g/l $Fe^{2+}$, 40–45° C., 30 sec. |
| 4 | dark-grey | 200 g/l HCl, 40 g/l $Fe^{2+}$, 25° C., 60 sec. |
| 5 | black | 200 g/l HCl, 40 g/l $Fe^{2+}$, 25° C., 30 seconds. followed by 100 g/l HCl, 20 g/l $Fe^{2+}$, 10 g/l $Fe^{3+}$, anodic, 20° C., 5 sec. |

*HMT is hexamethylenetetramine

BRIEF DESCRIPTION OF THE DRAWING

Referring to the drawings, FIGS. 1 to 5 summarize some of the pickling results obtained by performing the method of the present invention on steel wire. FIGS. *6a, 6b,* 7 and 8 schematize apparatus embodiments suitable for carrying out the method of this invention.

DETAILED DESCRIPTION OF THE INVENTION

Figure 1:
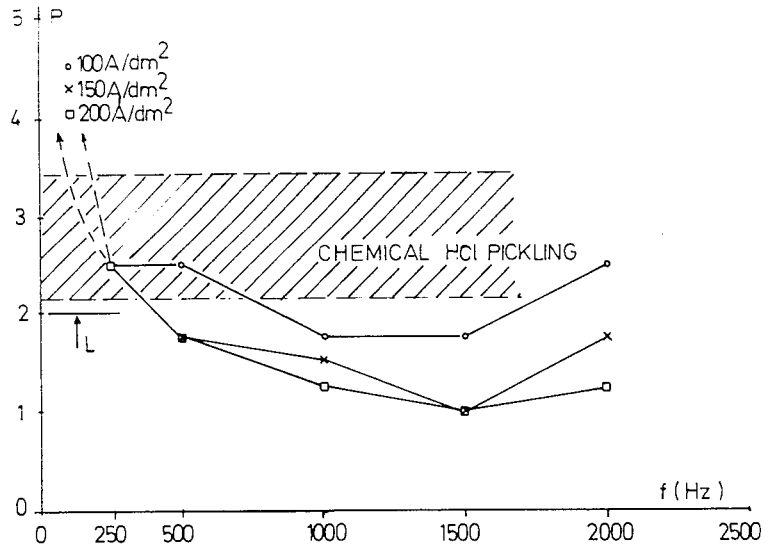

FIG. 1 shows the effect of frequency (f in Hertz) on the achievable degree of pickling (P) in an electrolytic solution of 250 g/l of HCl+20 g/l of $FeCl_2$ at 45° C. Below a frequency of 250 Hertz the pickling results become unreliable and often very poor. Above 1500 Hertz there is little additional gain. The shaded band is the normally encountered degree of pickling with conventional HCl-pickling and the line L corresponds to the best result according to prior art HCl-practice.

Figure 2:
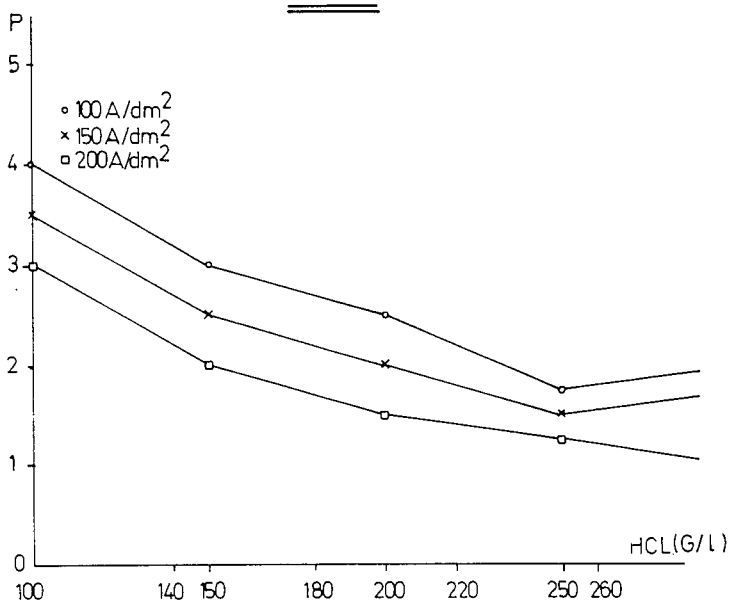

FIG. 2 shows the effect of HCl-concentration varying between 100 and 300 g/l (in the presence of 20 g/l of $FeCl_2$ and at 45° C.) on the obtainable degree of surface cleanliness when subjecting high-carbon steel wire to an A.C. current of 1000 Hertz with a current density rating of resp. 100, 150 and 200 A/dm$^2$.

Figure 3:
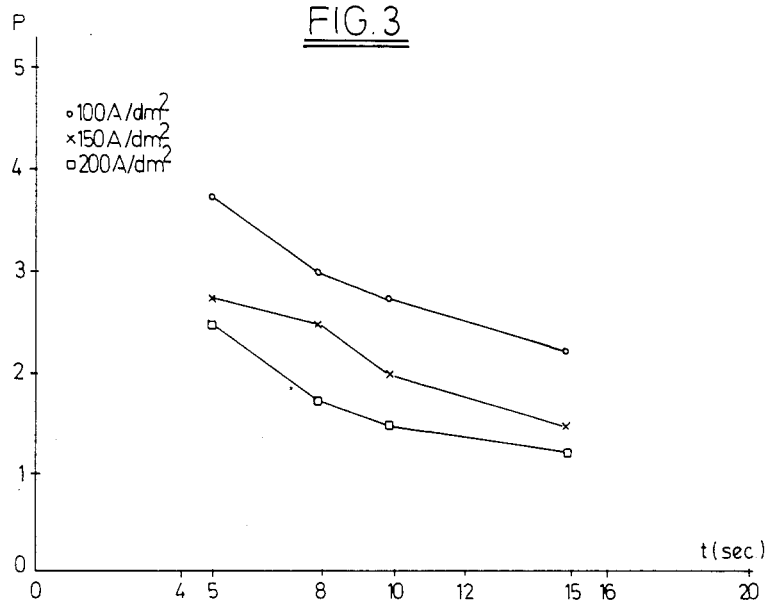

FIG. 3 illustrates the effect of total pickling time (40% chemical+60% electrolytical, resulting from the electrode configuration used) on the degree of pickling obtained by the method of this invention (1000 Hertz−200 g/l HCl+40 g/l $FeCl_2$ at 45° C.).

Figure 4:
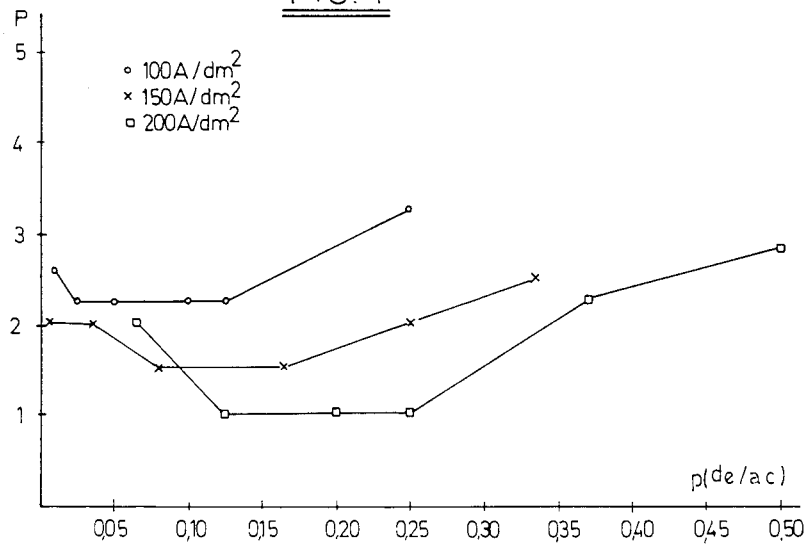

FIG. 4 shows the additional effect of superimposing a cathodic D.C. voltage (expressed as fraction p of applied A.C. voltage) on the achievable degree of pickling at 1000 Hertz in 200 g/l at 45° C. An optimum p-range related to applied A.C. current density is observed. A current density of 200 A/dm$^2$ gives extremely good results when p is in the range 0.10 to 0.30.

Figure 5:
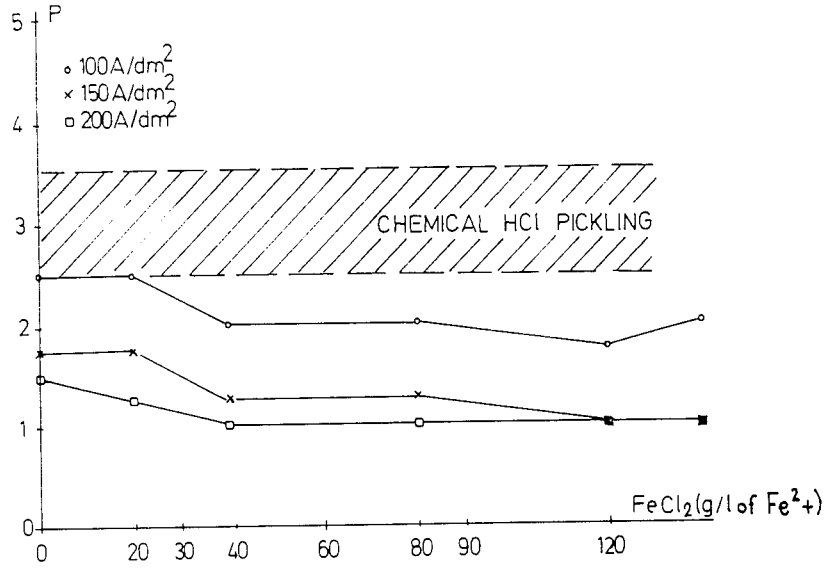

FIG. 5 shows the degree of pickling obtainable by combining an A.C. base current of 1000 Hertz with a superimposed cathodic voltage of respectively 1/20, 1/6 and 1/5 of the peak height of the applied A.C. voltage for current densities of 100, 150 and 200 A/dm$^2$ respectively. Pickling bath: 200 g/l HCl at 45° C., variable $FeCl_2$ content. Best results are obtained from 40 to about 120 g/l $FeCl_2$.

Figure 6A:
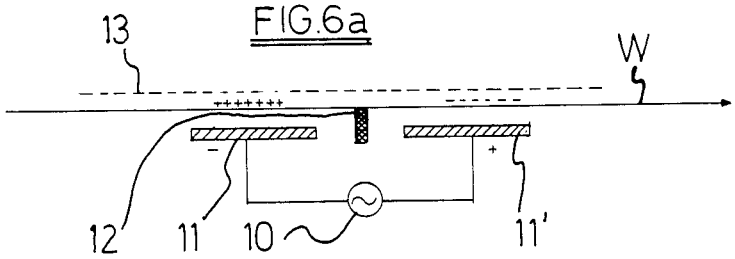
Figure 6B:
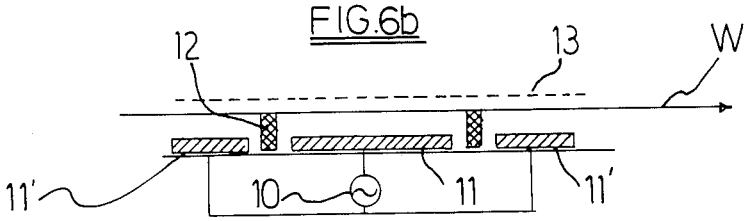

FIGS. 6*a* and 6*b* show schematically a non-contact electropickling cell, having respectively two (FIG. 6*a*) and three (FIG. 6*b*) spaced-apart electrodes connected to a single phase A.C. power supply. A power supply 10, electrodes 11 and a partition wall 12 which also supports the moving wire W are immersed in an electrolytic bath with electrolyte level 13.

Figure 7:
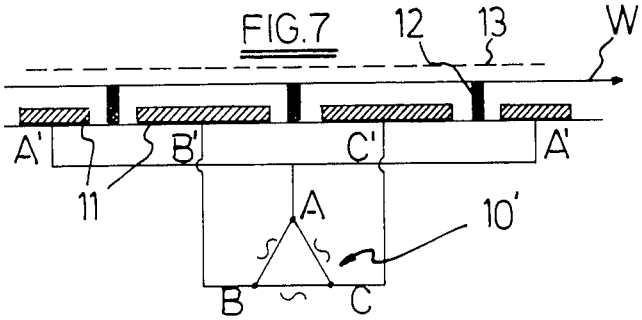

FIG. 7 shows schematically an apparatus arrangement for use with a three-phase current supply 10' of delta connection with phase terminals A, B and C. The apparatus can be used for non-contact electropickling according to the invention.

Figure 8:
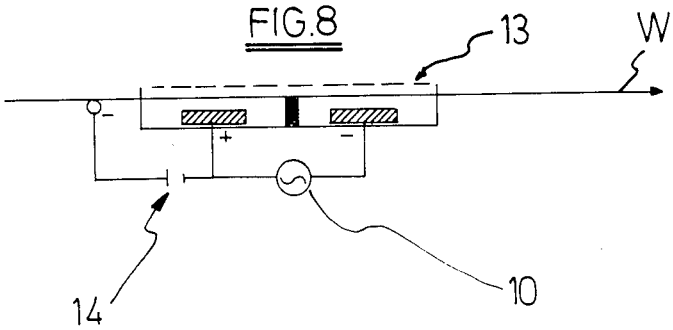

FIG. 8 illustrates a simplified arrangement for combining a suitable supply of A.C. base current 10 with superposition of a cathodic D.C. voltage or current 14, according to a preferred feature of the invention.

EXAMPLE 1

Drawn steel wire of 0.70% C and 1.5 mm diameter was first isothermally transformed (lead patenting) to pearlite and stored in ambient air for different times up to 6 months. The wire surface contained higher oxides, rust and small residues of burnt lubricant in varying amounts. The wires were immersed in a hydrochloric acid bath of 180 g/l of HCl at a temperature of about 60°-65° C. and pickled in different ways:

(a) chemical pickling for 30 seconds (b) electrolytic pickling for 5 seconds with alternating current of varying frequency.

The pickling results were as follows:

| | Pickling method | Wire surface evaluation |
|---|---|---|
| a. | Chemical pickling 30 sec. immersion | Poor pickling degree, traces of remaining scale, grey to dark grey colour |
| b. | Electrolytic pickling 5 sec. immersion 100 A/dm$^2$ | |
| b.1 | mains freq. of 50 Hertz | dark to inky black surface (smut) |
| b.2 | 500–2000 Hertz | clean surface, grey to silvery white, free of smut; very active wire |
| b.3 | 2000 to 5000 Hertz | less marked pickling effect than b.2, surface free of smut, but slower pickling rate |
| b.4 | 5000 to 50000 Hertz | insufficient and too slow pickling (change-over to polishing effect) |

Example 1 clearly demonstrates that high-frequency pickling of high-carbon steel wires in HCl in accordance with the present invention gives a considerable improvement in cleaning capability and wire surface purity as compared to conventional chemical pickling and to electrolytic A.C. pickling at mains frequency.

EXAMPLE 2

This example illustrates a specific embodiment of the method of this invention wherein a combination of low frequencies (outside the mains frequency range) and a particular electrolyte are used. Electrolytic pickling of 0.70% C patented steel wire in sodium sulphate solution: 150 g/l of $Na_2SO_4$, immersion time of 5 seconds, temperature of 40° C., current density of 100 A/dm$^2$.

A.C. frequency: wire surface

50 Hertz: smut, black coloured surface f>50 Hertz: smut, surface colour even darker f=1 to 10 Hertz: clean wire, free from smut

EXAMPLE 3

Lead-annealed drawn low-carbon steel wires (0.15% C—2.4 mm) containing oxide scale and partially carbonized lubricant residue on their surfaces were subjected to comparative pickling treatments:

| | | |
|---|---|---|
| I. | Conventional chemical pickling: | 140 g/l HCl - 70° C. 20 seconds |
| II. | Electrolytic pickling: (at mains frequency) | 110 g/l of HCl - 40 g/l of $FeCl_2$ - 50° C. 10 seconds frequency: 50 Hertz current density: 100 A/dm$^2$ |
| III. | Electropickling method: of this invention | 70–120 g/l of HCl 50° C. - 10 seconds frequency: 400 Hertz current density: 100 A/dm$^2$ |

The pickling results were as follows:

I. pickling degree (surface cleanliness) of 3 to 2 (dark grey to grey) - black spots are sporadically present.

II. pickling degree of 2 (grey), absence of black spots.

III. pickling degree of 2 to 1: iron grey to silvery white.

Surface cleanliness obtainable by the method of this invention is clearly superior. The method of this invention is thus suitable for the pickling of low-carbon steel wire, though with less spectacular results than obtainable on high-carbon steel wires.

In a second series of tests the process of the invention was tested more systematically on high-carbon steel wires, in particular the high-carbon range 0.50–1.0% C which covers most steel grades for high-performance applications. Said carbon steel wires are generally prone to smut formation on pickling in hydrochloric acid solutions and require careful pickling conditions to obtain adequate surface cleanliness. Activation of the pickling process with normal A.C. (mains frequency) unavoidably causes black smut and surface deterioration. Therefore, a most important object of the present invention was to solve this persistent problem. Further objects were to improve the surface treatment of steel wires with regard to pickling speed, reliability and ultimate degree of cleanliness as compared to the present limits of conventional chemical pickling in HCl.

EXAMPLE 4 (FIGS. 1 TO 3)

Patented 0.80% C steel wire of 1.25 mm diameter normally has a black oxidized surface. Conventional pickling in a hydrochloric acid bath usually attains a degree of pickling of about 3–3.5 (grey to light dark grey surface); in the best conditions, referring to a two-bath system (precleaning HCl-bath followed by desmutting bath of increased HCl concentrations up to 250–300 g/l) a degree of pickling of 2–3 is obtainable with total immersion times of about 15–20 seconds and bath temperatures of 60°–70° C. The wires were treated according to the electropickling method of this invention at a specified high frequency above 200 Hertz, more particularly in the range 250 to 5000 Hertz in which the preferred working range was from 500 to 1500 Hertz. A.C. current density applied to the wires was varied from about 50 to 500 A/dm$^2$ in an aqueous acid electrolyte containing from 100 to 300 g/l of HCl and up to 140 g/l of $FeCl_2$.

Excellent pickling results (significantly better than degree (3) were obtained in the following conditions:

frequency 1000 Hertz, current density 100 to 200 A/dm$^2$ pickling bath: 150 to 250 g/l of HCl, up to 50 g/l of $FeCl_2$; temperature 40° to 60° C.

A really outstanding surface cleanliness, comparable to degree 2 (light iron grey) and mostly better (silver grey to white), hitherto unachievable with conventional HCl pickling, was consistently obtained in a short time of 8 to 10 seconds by treating the wires at 1000 Hertz and 200 A/dm$^2$ in a pickling bath containing 200 g/l of HCl at 45° C. (or 150 g/l at 60° C.) with an optional amount of $FeCl_2$ (usually 20–40 g/l) which may rise to about 100 g/l without affecting surface purity.

EXAMPLE 5

Drawn 0.65% C steel wire of 1.50 mm diameter was alkaline degreased and lead annealed at 450° C., leaving oxide and burnt lubricant residues on the wire surface. Conventional high-speed in-line pickling for about 3.5–4 seconds in a hydrochloric acid bath (200–250 g/l of HCl+40–60 g/l of $FeCl_2$ at 60° C.) gives a degree of pickling of at best 3 whereby the wire surface has an irregular lustrous aspect.

The same wire material was subjected to electrolytic pickling in an aqueous electrolyte of 200 g/l HCl+40 g/l $FeCl_2$ at 45° and 60° C. with an A.C. current of 1000 Hertz and 150–200 A/dm$^2$. In these conditions a surface cleanliness of 2 to 3 was reliably achievable in 2 to 3 seconds; in addition the wire surface showed a uniform satin grey aspect pointing to an improved and regular surface reactivity which is more beneficial for subsequent finishing than conventionally pickled wire.

EXAMPLE 6 (FIGS. 4 AND 5)

To further improve cleaning efficiency and surface quality achievable by performing the method of this invention the applied electrolyzing A.C. of specified frequency may be combined with a superposed D.C.

A cathodic D.C. voltage of suitable magnitude was applied to a typical A.C. hydrochloric acid pickling system according to the invention.

The magnitude of the cathodic shift may vary, but is preferably related to the amplitude of the applied A.C. current cycle in a way so as to encompass a predetermined fraction of the peak voltage value of applied A.C.

At 1000 Hertz we found the following values (FIG. 4) to be satisfactory for said cathodic superposition when pickling steel wire in a HCl-bath containing 150 to 250 g/l of HCl and up to 140 g/l of $FeCl_2$ with a basic A.C. having a density of 100 to 200 A/dm$^2$:

100 A/dm$^2$: cathodic shift corresponding to about 1/50 to 1/6 of total A.C. voltage with optimum improvement range of 1/20 to $\frac{1}{8}$.

150 A/dm$^2$: cathodic shift corresponding to about 1/20 to 1/5 of total range, and most preferable range of 1/15 to 1/6.

200 A/dm$^2$: cathodic shift corresponding to about 1/15 to $\frac{1}{3}$ of total voltage and most preferably $\frac{1}{8}$ to $\frac{1}{4}$.

As a result of said optimum cathodic superposition we were able to obtain a significant additional improvement in surface cleanliness often amounting to about one unit on the comparative degree of pickling scale. The achievable degree of pickling often corresponds to the maximum value of surface purity (value 1 of the degree of pickling scale) as illustrated in FIG. 5, in particular for high-carbon steel wire pickled at 1000 Hz in a solution of 200 g/l of HCl with varying $FeCl_2$-content.

The process and apparatus of the present invention may also be used for the electrochemical pickling of strands other than ferrous strands. Examples of other metals to which the invention can be applied include non-ferrous metals (for instance aluminium) and non-ferrous alloys (for instance nickel-based heat-resistant alloys).

Our copending Application No. 85-17605 in Great Britain with the same priority date (July 12th 1985) of today's application (priority GB 85-17606) further describes process conditions and apparatus suitable for use in the present invention, the process conditions being especially suitable for the treatment of low carbon ferrous strands. The description and drawings of Application No. 85-17605 are to be understood as part of the description and additional drawings for the present application.

We claim:

1. A process for cleaning a carbon steel strand with more than 0.30% C by means of an electrochemical pickling method comprising:

passing the strand to be cleaned through an electrolytic pickling bath comprising an aqueous solution of hydrochloric acid, and subjecting the strand therein to the action of an alternating current having a density of at least 25 A/dm$^2$ and a frequency of at least 200 Hertz, thereby producing a substantially bare strand.

2. A process as claimed in claim 1 wherein the carbon content of the steel is comprised in the range from 0.50 to 1%.

3. A process as claimed in claim 1 wherein the electrolytic pickling bath contains from 50 to 300 g/l of hydrochloric acid and from 0 to 150 g/l of ferrous chloride.

4. A process as claimed in claim 1 wherein the electrolytic pickling bath contains from 100 to 300 g/l of hydrochloric acid and from 0 to 120 g/l of ferrous chloride.

5. A process as claimed in claim 1 wherein said alternating current has a density in the range from 25 to 500 $A/dm^2$ and a frequency in the range from 250 to 5000 Hertz.

6. A process as claimed in claim 1 wherein said alternating current has a density in the range from 50 to 300 $A/dm^2$ and a frequency in the range from 500 to 2000 Hertz.

7. A process as claimed in claim 1 wherein the normal wave of the alternating current is modified into a rectangular, trapezoidal or pulsed wave form.

8. A process as claimed in claim 1 wherein a direct current of cathodic voltage is superposed on said alternating current, said direct current being in the range between 0 and 50% of the peak amplitude of said alternating current.

9. A process as claimed in claim 1, wherein said alternating current has a density in the range from 50 to 300 $A/dm^2$ and a frequency of from 500 to 1500 Hertz and wherein a direct current of cathodic voltage is superposed on said alternating current, said direct current being in the range between 0.02 and 0.35 times the peak amplitude of said alternating current.

10. A process as claimed in claim 1, including continuously conveying the strand past a plurality of spaced apart electrodes arranged along the path of travel so that the strand passes in turn within a predetermined close distance of each of said electrodes, providing said aqueous solution of hydrochloric acid in the space between each of the said electrodes and the portion of the strand which is adjacent thereto, and applying between pairs of adjacent electrodes an alternating voltage, whereby said alternating current is produced, the strand serving as an intermediate conductor between said adjacent electrodes.

11. A process as claimed in claim 10 in which a single phase alternating voltage power supply is used with two phase terminals, and wherein subsequent electrodes are alternately connected to the one and to the other terminal.

12. A process as claimed in claim 10 in which a three phase alternating voltage power supply is used with three phase terminals, and wherein subsequent electrodes are connected in cyclic succession to the first, second and third of said terminals.

13. A process as claimed in claim 10 wherein the strand to be cleaned is conveyed along a rectilinear and horizontal path through an electrolytic overflow bath past a series of at least two spaced-apart electrodes submerged therein.

* * * * *